US006652126B2

(12) United States Patent
Lu

(10) Patent No.: US 6,652,126 B2
(45) Date of Patent: Nov. 25, 2003

(54) STRUCTURE OF A FOLDABLE LAMPSHADE

(76) Inventor: Chin Lung Lu, P.O. Box 82-144, Taipei (TW)

( * ) Notice: Subject to any disclaimer, the term of this patent is extended or adjusted under 35 U.S.C. 154(b) by 0 days.

(21) Appl. No.: 10/138,252

(22) Filed: May 6, 2002

(65) Prior Publication Data

US 2003/0142498 A1 Jul. 31, 2003

(30) Foreign Application Priority Data

Jan. 25, 2002 (TW) ..... 91200719 U

(51) Int. Cl.[7] ..... F21V 1/06
(52) U.S. Cl. ..... 362/352; 362/357
(58) Field of Search ..... 362/351, 352, 362/358, 434, 450, 355, 356, 357; 403/195, 242

(56) References Cited

U.S. PATENT DOCUMENTS 4,354,222 A * 10/1982 Gall ..... 362/352
6,315,434 B1 * 11/2001 Long ..... 362/352

* cited by examiner

*Primary Examiner*—Alan Cariaso
*Assistant Examiner*—Ali Alavi
(74) *Attorney, Agent, or Firm*—Leong C. Lei

(57) ABSTRACT

A structure of a foldable lampshade is disclosed. The foldable lampshade comprises an upper and a lower securing ring, an outer shade for connecting the upper and the lower securing ring, and one or more supporting frame, characterized in that the supporting frame is detachable and/or mountable with the securing rings such that the outer shade can be folded or stacked to a minimum size. A connection end of the upper securing ring is provided with a snap slot for connection with the snap plate provided on the upper securing ring. One end of the supporting frame is mounted to the lower securing ring.

1 Claim, 3 Drawing Sheets

STRUCTURE OF A FOLDABLE LAMPSHADE

BACKGROUND OF THE INVENTION (a) Field of the Invention

The present invention relates to structure of a foldable lampshade, and in particular, to a lampshade having components, which can be folded so that the entire structure of the lampshade can be stacked.

(b) Description of the Prior Art

Conventional lampshades are cauterized into 3 types with respect to their structure, i.e. (a) a lampshade with supporting frame mounted within the inner side thereof and connecting one end of the upper and lower securing ring, (b) a lampshade having an outer shade cover and a liner between the inner side and outer side of the supporting frame, and (c) a lampshade with detachable supporting frame mounted between an outer shade cover and the liner. These conventional lampshade structures have the following drawbacks:

(i) There are shadows of the supporting frame formed on the outer shade cover;

(ii) If the supporting frame is positioned between the outer shade cover and the liner, the lampshade cannot be folded.

(iii) It is laborious to dispose the supporting frame in between the outer shade cover and the liner.

(iv) The supporting frame for some lampshades has to be smaller than the diameter of the lower securing ring of the lampshade.

SUMMARY OF THE INVENTION

It is an object of the present invention to provide a structure of a lampshade, which can be folded, and of simple structure, which mitigates the drawbacks of the conventional lampshade.

Yet another object of the present invention is to provide a structure of a foldable lampshade, wherein the supporting frame will not produce a shadow when a bulb within the lampshade is lighted.

An aspect of the present invention is to provide with a structure of a foldable lampshade having an upper and a lower securing ring, an outer shade for connecting the upper and the lower securing ring, and one or more supporting frame, characterized in that the supporting frame is detachable and/or mountable with the securing rings such that the outer shade can be folded or stacked to a minimum size.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1B:
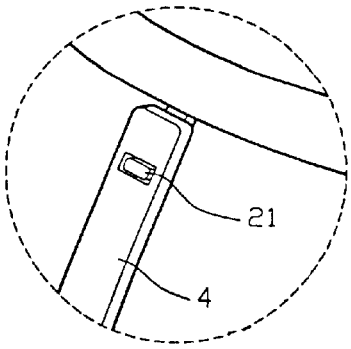
FIGS. 1B, 1C, 1D and 1E are enlarged view of different portions of FIG. 1A.
Figure 1C:
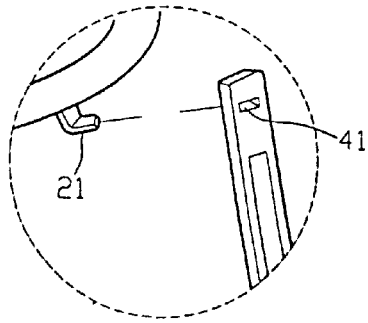
Figure 1A:
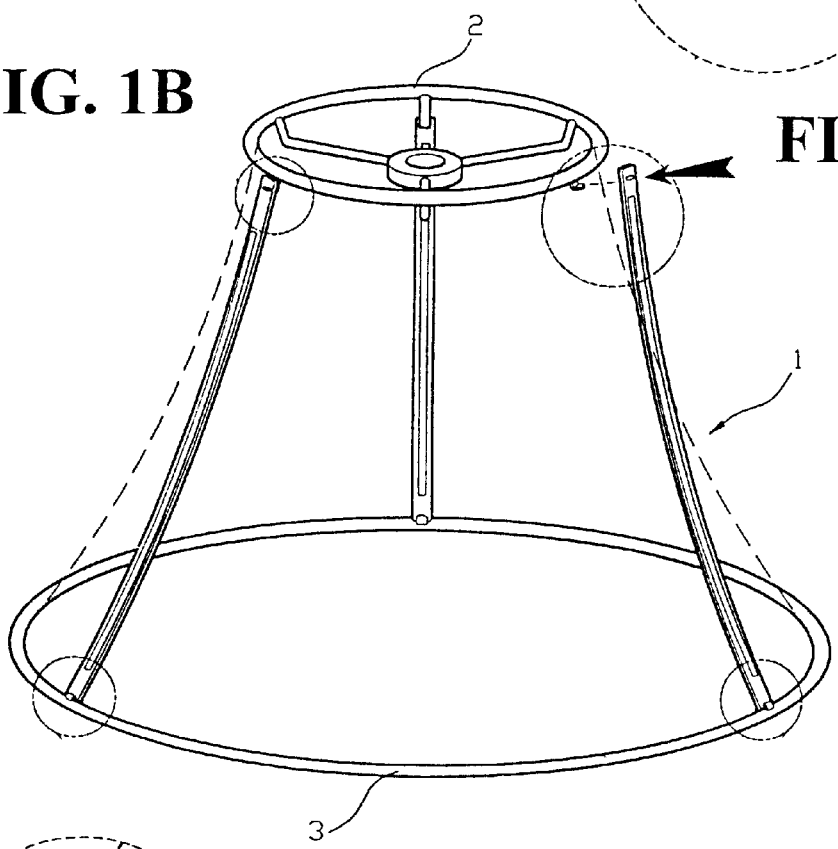
FIG. 1A show a schematic view of the internal frame of the foldable frame structure in accordance with a preferred embodiment of the present invention.
Figure 1D:
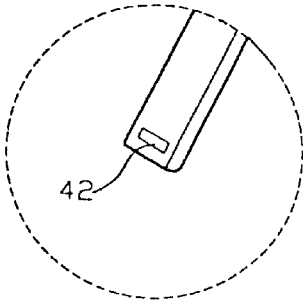
Figure 1E:
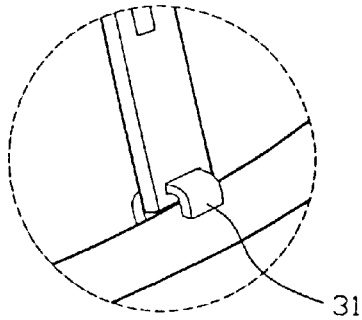

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1A, 1B, 1C, 1D and 1E, there is shown a foldable lampshade comprising an outer shade having a top opening and a bottom opening, an upper securing ring 2 and a lower securing ring 3 and the outer shade 1 is located between the upper securing ring 2 and the lower securing ring 3. The outer diameter of the upper securing ring 2 is smaller than that of the lower securing ring 3. The upper securing ring 2 is provided with a snap plate 21 for connection correspondingly with the supporting frame 4. The lower securing ring 3 is provided with a securing plate 31 for mounting with the supporting frame 4. One end of the supporting frame 4 is provided with a snap slot 41 for interconnect with the snap plate 21 of the upper securing ring 2. The other end of the supporting frame 4 is provided with a securing hole 42 for securing with the lower securing plate 31.

In accordance with the present invention, as the upper and lower opening end of the outer shade 1 is fitted to the outer diameter between the upper securing ring 2 and the lower securing ring 3 (for dual layer outer shade, the outer shade being mounted at the outer diameter and the liner being mounted at the external diameter). Due to the fact that the external diameters of the two securing rings are different, when the supporting frame 4 is extended, a conic shape with arch-line lampshade is formed and the supporting frame 4 is positioned at the outer side of the outer shade 1.

Figure 2B:
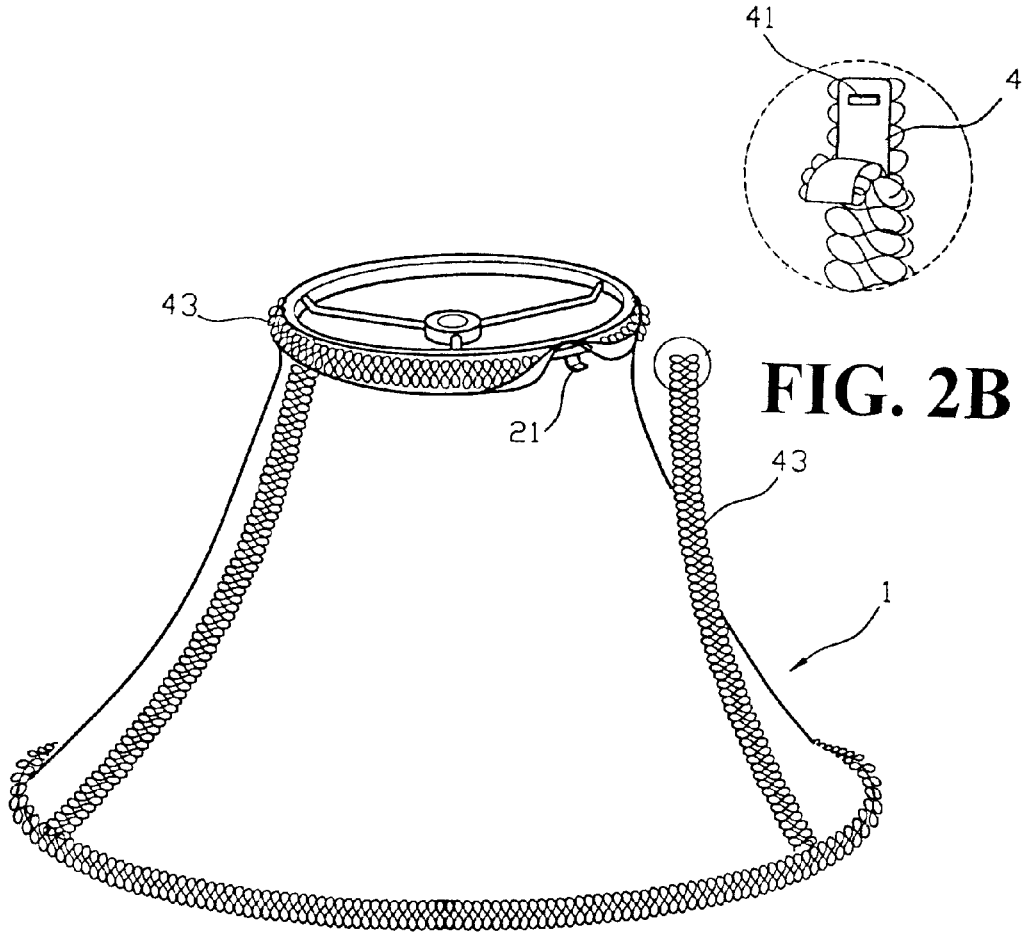
FIG. 2B is an enlarged view of a portion of FIG. 2A.
Figure 2A:
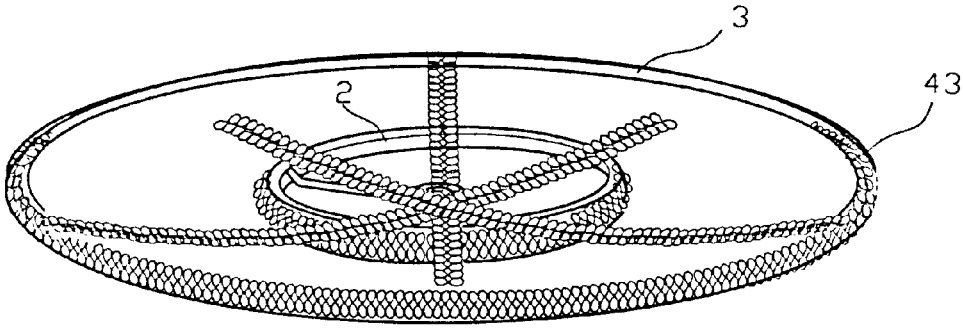
FIG. 2A shows a schematic view of the foldable lampshade containing an outer shade in accordance with the preferred embodiment of the present invention.

Referring to FIGS. 2A and 2B, based on the ornamental designs of the outer shade, the supporting frame 4 can be mounted with an ornamental design 43 in the course of fabricating the supporting frame 4, such that the supporting frame 4 and the outer shade is formed into a lampshade in accordance with the present invention.

Figure 3:
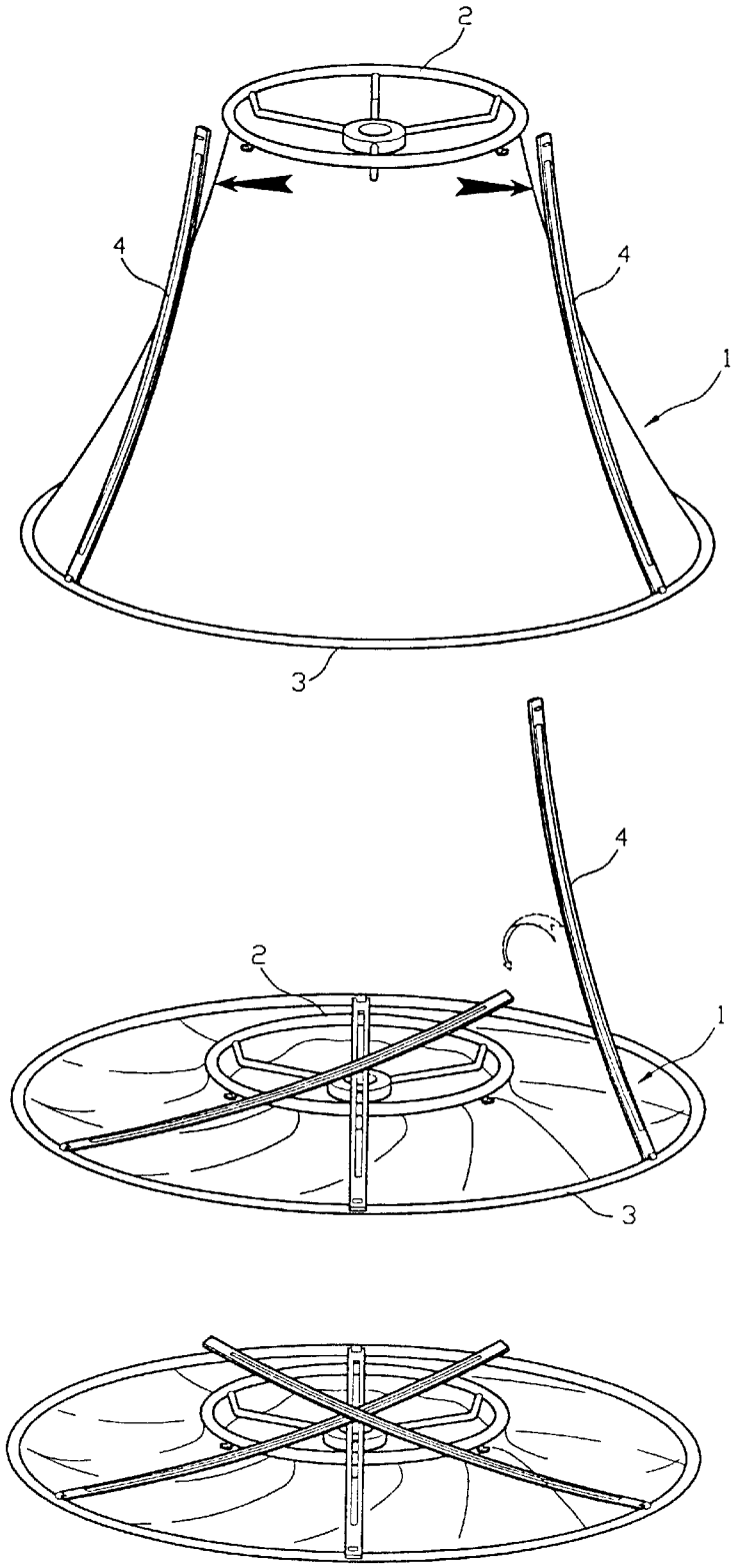
FIG. 3 is an operational view showing the folding of the lampshade in accordance with the present invention.

Referring to FIG. 3, when dismantling the lampshade structure for packing, the snap slot 41 of the supporting frame 4 is separated from the snap plate 21 of the upper securing ring 2 and the outer shade is pressed downward from the top to the bottom so that the entire structure becomes a substantial flat disc shape. After that a plurality of supporting frames 4 are lowered towards the center of the lampshade structure such that the supporting frames are stacked onto the upper securing ring 2 and the height of the lampshade is at a minimum.

In accordance with the present invention, the method of connection of the supporting frame can be any time of a male and a female connector. In view of the structure of the lampshade of the present invention, the length of the supporting frame can be larger than the diameter of the lower securing ring and the frame will not damage the lampshade in the course of folding or stacking.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a foldable lampshade having an upper and a lower securing ring, an outer shade for connecting the upper and the lower securing ring, and one or more supporting frame, wherein the supporting frame is detachably mounted with the securing rings and disposed on an outer side of said outer shade such that the outer shade can be folded or stacked to a minimum size, and wherein the supporting frame is mounted with an ornamental member.

* * * * *